US006102715A

United States Patent [19]

Centofante

[11] Patent Number: 6,102,715

[45] Date of Patent: Aug. 15, 2000

[54] PERSONAL COMPUTER PERIPHERAL DEVICE ADAPTER

[75] Inventor: Charles A. Centofante, Los Altos, Calif.

[73] Assignee: The Great American Gumball Corporation, Santa Clara, Calif.

[21] Appl. No.: 09/021,463

[22] Filed: Feb. 10, 1998

[51] Int. Cl.[7] ..... H01R 13/44

[52] U.S. Cl. ..... 439/140; 439/64; 361/747

[58] Field of Search ..... 439/140, 141, 439/64; 361/747, 727

[56] References Cited

U.S. PATENT DOCUMENTS

| | | | |
|---|---|---|---|
| 3,651,444 | 3/1972 | Desso et al. | 439/141 |
| 3,747,047 | 7/1973 | Carter et al. | 439/141 |
| 3,839,697 | 10/1974 | Obert | 439/141 |
| 4,445,739 | 5/1984 | Wooten | 439/140 |
| 4,695,925 | 9/1987 | Kodai et al. | 361/737 |
| 4,810,199 | 3/1989 | Kar | 439/141 |
| 4,868,714 | 9/1989 | Banjo et al. | 361/737 |
| 4,924,077 | 5/1990 | Banjo et al. | 235/492 |
| 4,955,817 | 9/1990 | Sugai | 439/60 |
| 4,959,609 | 9/1990 | Prokopp et al. | 324/158 |
| 5,030,119 | 7/1991 | Lowe | 439/141 |
| 5,035,633 | 7/1991 | Kobayashi et al. | 439/140 |
| 5,035,635 | 7/1991 | Tsai et al. | 439/140 |
| 5,412,550 | 5/1995 | Hsieh et al. | 362/226 |
| 5,466,164 | 11/1995 | Miyazaki et al. | 439/140 |
| 5,490,891 | 2/1996 | Farquhar et al. | 156/73.1 |
| 5,518,411 | 5/1996 | Belleci | 439/141 |
| 5,599,196 | 2/1997 | Powell et al. | 439/141 |
| 5,608,606 | 3/1997 | Blaney | 439/64 |
| 5,779,491 | 7/1998 | Nagano et al. | 439/141 |
| 5,846,092 | 12/1998 | Feldman et al. | 439/76.1 |

FOREIGN PATENT DOCUMENTS

| | | |
|---|---|---|
| 0 344 850 A2 | 12/1989 | European Pat. Off. . |
| 32 23 494 A1 | 12/1983 | Germany . |
| 36 10009 A1 | 10/1987 | Germany . |

*Primary Examiner*—Renee S. Luebke
*Assistant Examiner*—T C Patel
*Attorney, Agent, or Firm*—Fish & Richardson P.C.

[57] ABSTRACT

An adapter to connect either Type I or Type II cards into a PCMCIA compliant PC Card interface on a personal computer. A protective shutter mechanism receives both Type I and Type II cards.

16 Claims, 4 Drawing Sheets

PERSONAL COMPUTER PERIPHERAL DEVICE ADAPTER

BACKGROUND

The invention relates to adapters for connecting devices to personal computers.

To expand the capacity and functional capability of portable laptops, computers, and other types of electronic devices, manufacturers developed "plug-in"peripheral cards containing circuits and devices such as memories and modems.

Because of the many possible methods of constructing the interface between a computer and a peripheral card device, standards were developed by the Personal Computer Memory Card International Association ("PCMCIA"), Japan Electronic Data Interchange Council ("JEDIC"), International Organization for Standardization ("ISO"), Compact Flash Association ("CFA"), and others. Standards for PC Cards (formerly called PCMCIA Cards) require that they have a length of approximately 85 mm, a width of 54 mm, and a maximum thickness of 5 mm.

For example, U.S. Pat. No. 5,490,891 (the '891 Patent), incorporated herein by reference, discloses a housing for such a PC card, and a process for making same. The housing disclosed in the '891 Patent meets standards defined in the PCMCIA CompactFlash Specification Revision 2.1.1, incorporated herein by reference.

Following the introduction of PC cards, small flash memory devices, often referred to as CompactFlash™ cards, were introduced for use with personal electronic products, such as digital cameras and cellular phones. In keeping with the trend of developing smaller devices, CompactFlash cards were even smaller in size than PC Cards. One format for CompactFlash cards was promulgated by the CFA. A card with this format, which will be referred to as a Type I card, has an approximate length of 36 mm, an approximate width of 42 mm, and an approximate thickness of 3.3 mm. Type I cards were originally intended for use with products other than personal computers. Therefore, to connect a Type I card to a personal computer, an adaptor providing a PCMCIA interface at one end and an interface for the Type I card at the other end is used. These adapters will be referred to as Type I adapters. The Type I adapter plugs into the personal computer interface for PC Cards and the Type I card plugs into the Type I adapter.

More recently, a new format for CompactFlash cards that differs from the form factor of a Type I card has been proposed. A card with this new format, which will be referred to as a Type II card, has the same width and length as a Type I card but is thicker than the Type I card. In fact, Type II cards are as thick as PC Cards and Type I Adapters. Due to its thickness, the Type II card does not fit inside a standard PC Card housing or a Type I adapter. Consequently, the Type II card cannot be used with the Type I adapters currently used with Type I cards.

It may be noted that the position of the Type II card socket holes and pins with respect to the bottom of the card is the same as that for the Type I card. Therefore, the Type II card's socket holes are offset from its center toward the bottom of the card on account of the Type II card's increased thickness.

Type II cards have grooves, approximately 1.0–1.2 mm deep, 36.4 mm long, and 1.7 mm high, running along the two side walls that correspond to the grooves running along the side walls of the Type I card. The grooves on the Type II card are offset toward the bottom of the card.

Standards covering the Type II card have been proposed. These proposed standards require that Type II cards have a thickness of no more than 5 mm, and that the center line of the holes be approximately 1 mm above the bottom of the Type II card.

SUMMARY

The invention provides an adapter configured to connect both Type I and Type II cards into a PCMCIA compliant PC Card interface on a personal computer. More specifically, the invention provides a protective shutter mechanism adapted to receive both Type I and Type II cards.

In one aspect, the invention is directed to an apparatus comprising a header and a shutter. The header has a front face, two side walls extending from the header front face, and male connector pins extending from the header front face substantially parallel to the side walls. The inner surface of each side wall includes a guide rail. The shutter has a front face, a rear face, two sides with grooves slidably engaging the guide rails, a planar sheet projecting from an edge of the shutter rear face, and a plurality of holes extending from the shutter front face to the shutter rear face and corresponding to the male connector pins.

Implementations of the invention may include the following. A connector pin may be secured to the shutter and may extend through and slidably engage an aperture through the header. The planar sheet may include a lip to limit forward motion of the shutter by engaging the header, and the lip may be located on a tab extending from the planar sheet. A spring may bias the shutter away from the header. The holes in the shutter may be offset from the center toward the bottom of the shutter. A shroud may be connected to the shutter opposite the planar sheet, and a flange may run along a top and a bottom of the shutter front face. The apparatus may also include a frame having opposing side rails forming a bay at one end, a female connector disposed in an end of the frame opposite the bay, and an electrical connection between the female connector and the male connector pins in the header. The header may be disposed between the bay and the female connector, and the holes of the shutter may face the bay. The female and male connectors may conform to PCMCIA standards.

In another aspect, the invention is directed to a dual mode adapter comprising a female connector, a male connector having a plurality of pins, an electrical connection between the female connector and the male connector, a shield for covering the pins in the male connector, and a housing for supporting the female connector, male connector and shield. The shield has a planar sheet with a lip and a plurality of holes corresponding to the pins in the male connector and is slidably engaged to the male connector. The housing defines a bay at the end of the adaptor opposite the female connector.

In another aspect, the invention is directed to a kit comprising a header and a shutter. The header has a front face, two side walls extending from the header front face, and male connector pins extending from the header front face substantially parallel to the side walls. The inner surface of each side wall includes a guide rail. The shutter has a front face, a rear face, two sides with grooves configured to slidably engage the guide rails, a planar sheet projecting from an edge of the shutter rear face, and a plurality of holes extending from the shutter front face to the shutter rear face and corresponding to the male connector pins.

In another aspect, the invention is directed to an apparatus for adapting a CompactFlash compatible electronic device to a PCMCIA compatible male connector. The apparatus comprises a PCMCIA compatible female connector, a CompactFlash compatible male connector, an electrical connection between the female connector and the male connector, and a housing supporting the male connector and the female connector. The housing has a top, a bottom, and a thickness between the top and the bottom that is essentially the maximum thickness that complies with the PCMCIA standard, and the male connector has pins arranged and the housing is configured to enable connection of either a type 1 or a type 2 CompactFlash electronic device to the male connector.

Implementation of the invention may include the following. The housing may include a bay which spans the full thickness of the housing and which spans enough of the width of the housing to accommodate the width of a CompactFlash-compatible electronic device. A CompactFlash Type 1-compatible or Type-2 compatible electronic device may be held fully within the bay, the CompactFlash device having a female connector mated with the male connector. The apparatus may include a shutter movable relative to the housing from a first position in which the pins are exposed for connection to a female connector to a second position in which the pins are protected.

In another aspect, the invention is directed to an apparatus comprising a connector assembly and a housing for the connector assembly. The connector assembly is configured to enable connection of either a type 1 or a type 2 CompactFlash electronic device to a PCMCIA compatible interface of a personal computer, and the housing has a top, a bottom, and a thickness between the top and the bottom that is essentially the maximum thickness that complies with the PCMCIA standard.

Among the advantages of the invention are one or more of the following. The dual mode adapter can be used with both Type I and Type II cards. The dual mode adapter shutter protects the male connector pins from damage when they are not engaged. The shutter and its locking mechanism are an integrated unitary piece, and as such, the dual mode adapter contains few parts and is unlikely to break. The dual mode adapter is easily and economically manufactured. The dual mode adapter is inexpensive, yet provides sufficient structural integrity in an aesthetically pleasing package.

Other features and advantages of the invention will become apparent from the following description and from the claims.

DETAILED DESCRIPTION

Figure 1A:
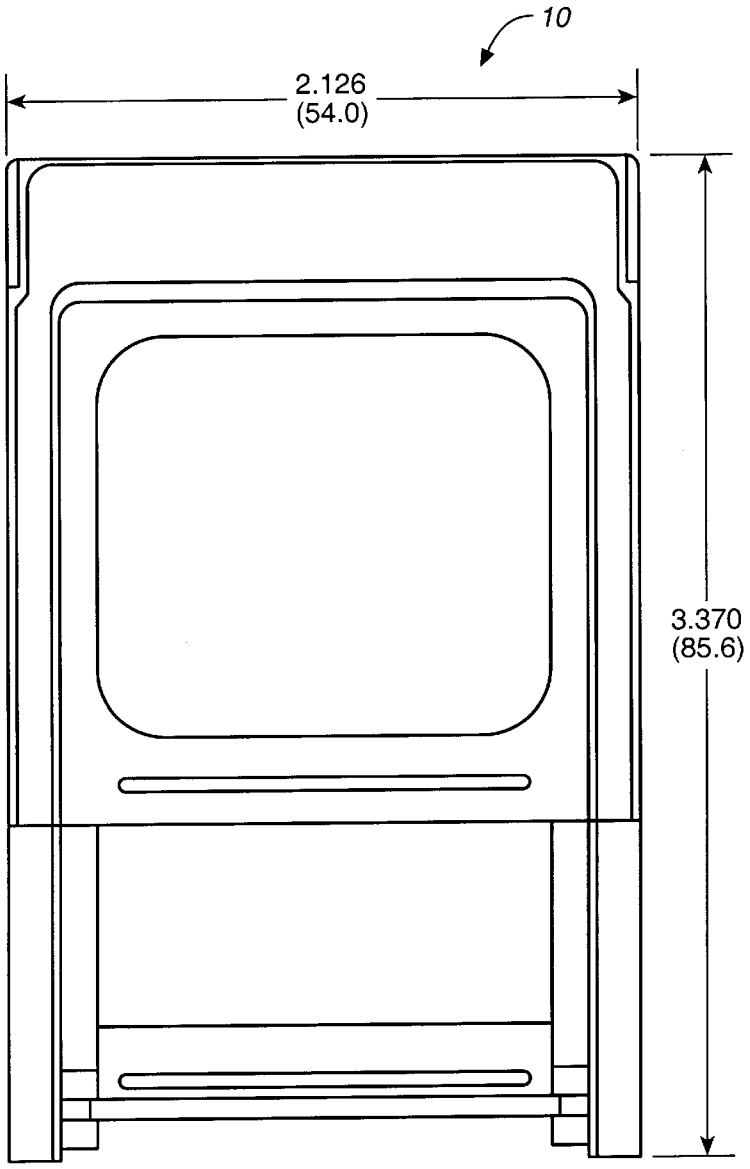
FIG. 1A is a top view of an assembled dual mode adapter.

Referring to FIGS. 1A–1D, a dual mode adapter 10 has two covers 101, 102, a frame 103 having a bay 104, a female connector 105, a header 106 having male connector pins 107, an electrical connection 108 between female connector 105 and header 106, a shutter 109, and two compression springs 110. When assembled, dual mode adapter 10 has a width and height conforming to PCMCIA standards set for PC Card devices. Namely, as assembled, the adapter has a length of approximately 85 mm, a width of approximately 54 mm, and is no more than approximately 5 mm thick.

Figure 1B:
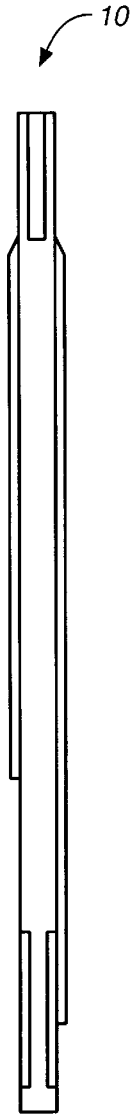
FIG. 1B is a side view of an assembled dual mode adapter.
Figure 1C:
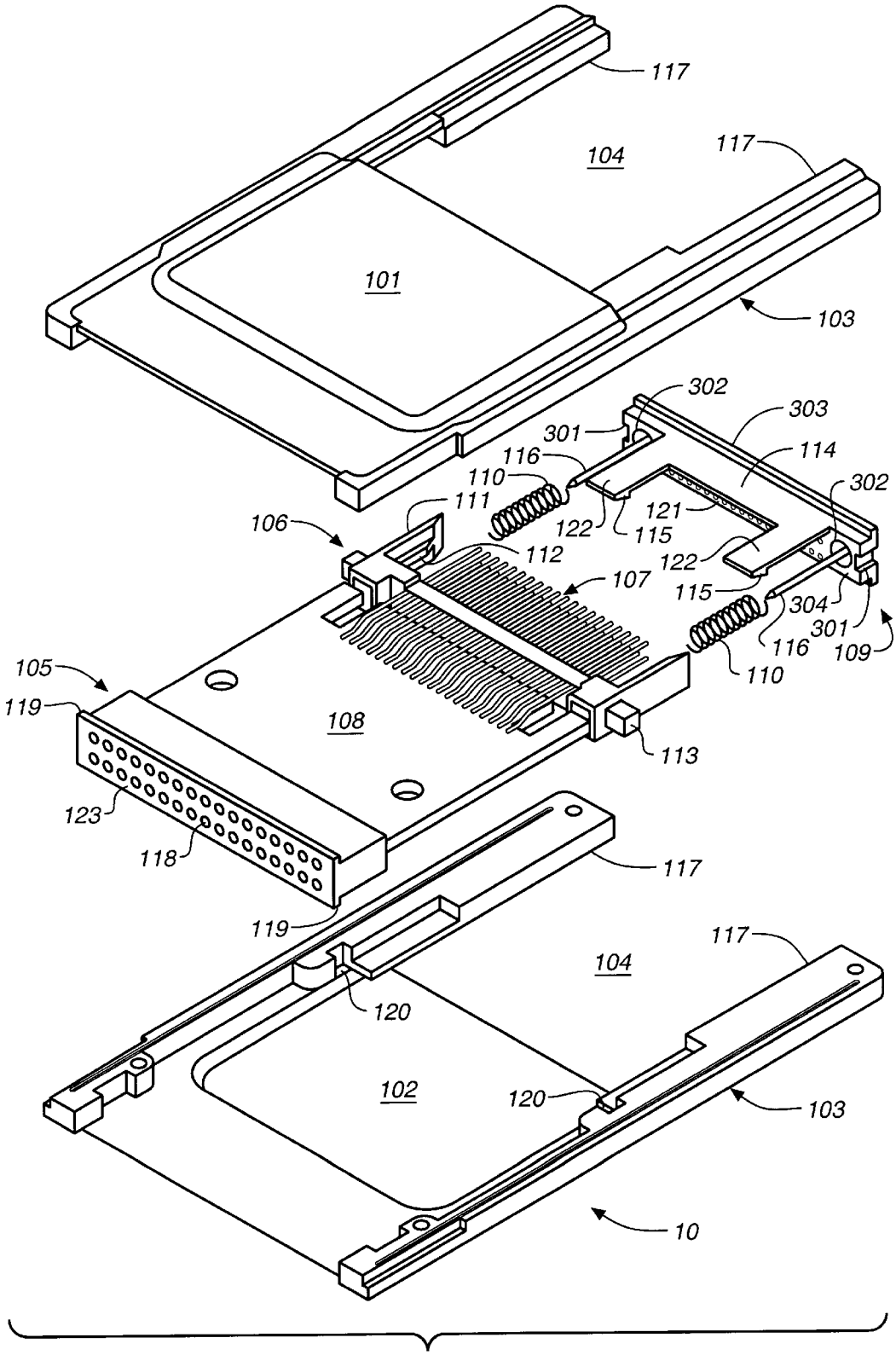
FIG. 1C is an exploded perspective view of a dual mode adapter.

As shown in FIG. 1C, covers 101, 102 may be substantially rectangular in shape and may be stamped from metal or formed from plastic material. The covers 101, 102 serve to protect the internal components of dual mode adapter 10. Covers 101, 102 are connected to frame 103 along their longer sides. In one embodiment, frame 103 includes two opposing side rails 117 to hold covers 101, 102 together. In another embodiment, side rails 117 of frame 103 may be held together by a pair of ribs (not shown) that intersect side rails 117 at an angle.

Frame 103 serves to hold covers 101, 102 together and support female connector 105, electrical connection 108, header 106, and shutter 109 between covers 101, 102. Side rails 117 of frame 103 form bay 104 in the front half of dual mode adapter 10. The dimensions of bay 104 are such that a Type I or Type II card conforming to CFA standards can slide into bay 104 and connect to header 106 through shutter 109. The frame 103, side rails 117 and ribs, if present, may be a unitary body formed from any suitable material.

Female connector 105 conforms to PCMCIA standards and is located at the end of the assembled dual mode adapter opposite bay 104. The outer face 123 of female connector 105 is rectangular and has holes 118 complying with PCMCIA standards to attach the dual mode adapter to a personal computer. The top and bottom edges of the outer face of female connector 105 each have a flange 119. When assembled, the edges of covers 101, 102 meet flanges 119 to encase all of female connector 105 except holes 118 in the body of dual mode adapter 10. This protects users from the sharp edges of covers 101, 102. The inner face of female connector 105 is electrically coupled to header 106 by electrical connection 108. Electrical connection 108 may be formed by any suitable medium, such as a printed circuit board (illustrated) or cables (not shown).

Figure 2:
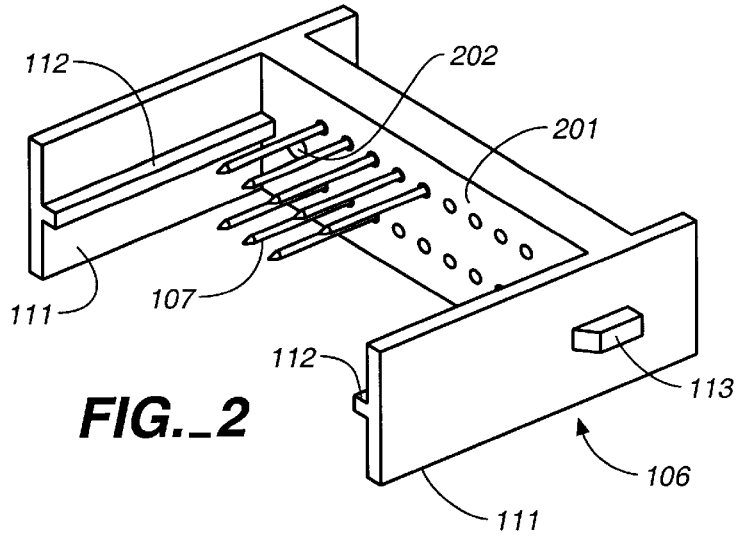
FIG. 2 is a detailed view of the header.

With reference to FIG. 2, header 106 has a rectangular front face 201 and two side walls which extend perpendicularly from the edges of front face 201 toward bay 104. Male connector pins 107 (only a representative sample of pins is shown), which conform to PCMCIA standards, project from front face 201 toward the front end of dual mode adapter 10. The side walls 111 are parallel to and longer than the male connecting pins. The inner surface of each side wall 111 has a guide rail 112. In addition, a knob 113 may extrude from the outer surface of each side wall 111 to fit within a corresponding slot 120 in frame 103 (see FIG. 1C).

Header 106 also includes two header apertures 202 (only one is shown in this perspective view) that extend from front face 201 to the back face of header 106. One aperture is located between male connector pins 107 and each side wall 111. Once the dual mode adapter is assembled, header 106 is located in the mid-section of frame 103 with male connection pins 107 facing bay 104 and its back face attached to electrical connector 108. Header 106 may be a unitary piece made of plastic material.

Figure 3:
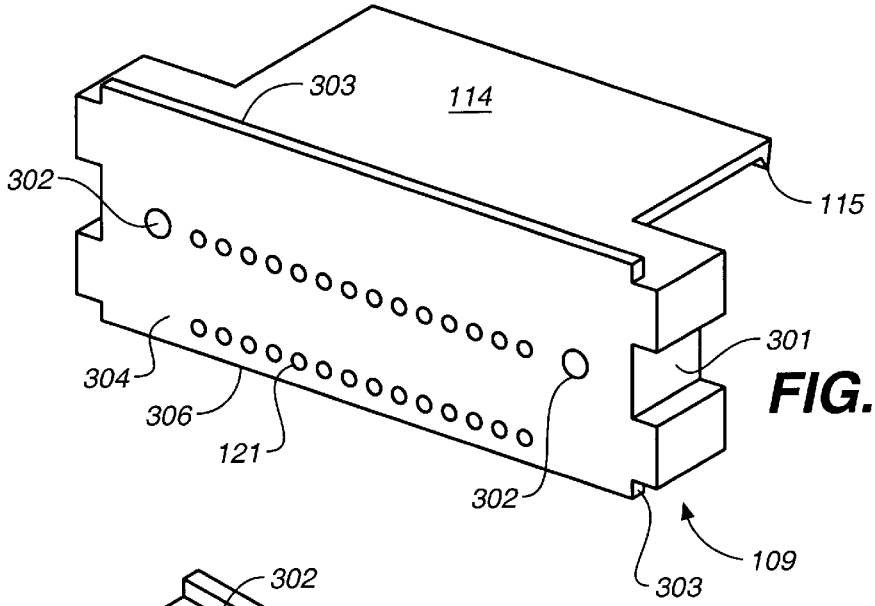
FIG. 3 is a detailed view of one embodiment of the shutter.

With reference to FIG. 3, shutter 109 is generally rectangular in shape. A thin flange 303 runs along the top and bottom edges of a front surface 304 of the shutter. When dual mode adapter 10 is assembled and a CompactFlash card is connected, covers 101, 102 are placed against flanges 303 to encase shutter 109 and protect consumers from the sharp edges of covers 101, 102.

The shutter 109 includes two grooves 301 which run along the outer surface of each side of shutter 109. Grooves 301 mate with header guide rails 112 to slidably connect shutter 109 to header 106 (see FIG. 1C). In addition, two shutter apertures 302 are formed in a back face 305 of the shutter, and may extend through the shutter to the front face 304.

Returning to FIG. 1C, two guide pins 116 are attached to shutter 109 and extend toward the back of the dual mode adapter. The guide pins 116 may be inserted into and frictionally secured in two shutter apertures 302. When shutter 109 is slidably connected to header 106 guide pins 116 extend into header apertures 202. The header apertures 202 are wider than guide pins 116 so that guide pins 116 slidably engage header 106. The compression springs 110, which are held in place by guide pins 116, bias shutter 109 away from front face 201 of header 106.

Shutter 109 also includes holes 121, corresponding in number and location with male connector pins 107, which extend through the shutter body from front face 304 to back face. In one embodiment, holes 121 may be offset from the center of shutter 109. For example, the center line of the bottom row of holes 121 may be approximately 1 mm above bottom surface. With this offset, both Type I and Type II cards can be used with the dual mode adapter 10. This offset, however, may not be required for other embodiments. Holes 121 are spaced to coincide with male connector pins 107 when shutter 109 and header 106 are engaged.

A relatively thin planar sheet 114 is connected to the top back edge of shutter 109. A lip 115 extends along a rim of planar sheet 114. Shutter 109, including holes 121, planar surface 114, flanges 303 and grooves 301, may be an integrated unitary piece formed from plastic material.

When bay 104 is empty, compression springs 110 urge shutter 109 into its forwardmost position so that planar sheet 114 covers and protects male connector pins 107. When a Type I or II card is inserted into bay 104, shutter 109 is forced back so that planar sheet 114 slips between cover 101 and electrical connection 108 and male connector pins 107 extend through holes 121 to engage the card. When the Type I or II card is removed, compression springs 110 force shutter 109 forward over male connector pins 107. The lip 115 engages the bottom rear edge of header 106 to limit the forward motion of shutter 109 and lock the shutter in place (see FIG. 1D). When shutter 109 is in its forwardmost position, the tips of male connector pins 107 are protected by the body of shutter 109, and planar sheet 114 covers one side of the unengaged male connector pins 107.

Figure 1D:
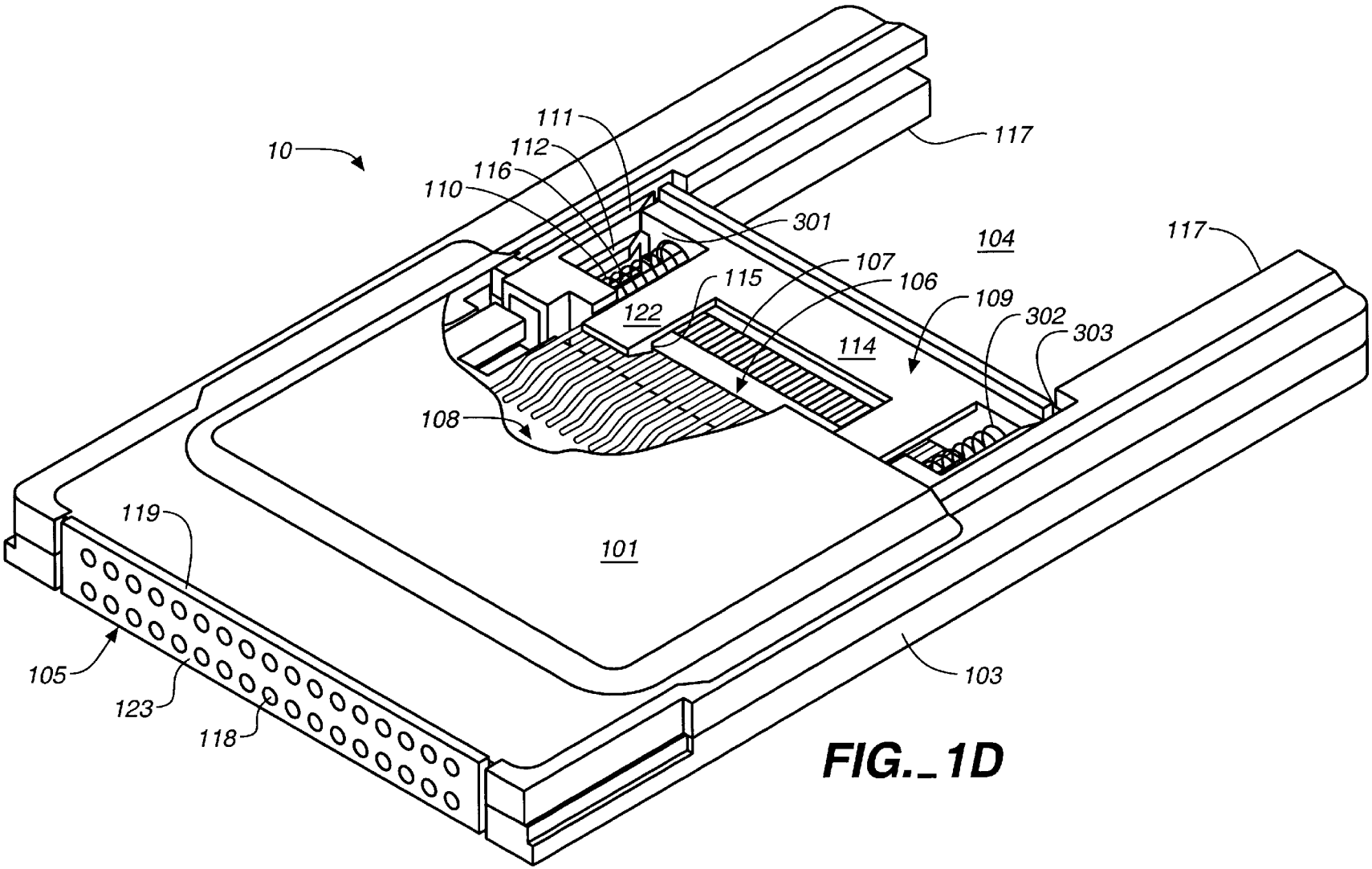
FIG. 1D is a perspective view, partially cross-sectional, of an assembled dual mode adapter.

As shown in FIG. 3, lip 115 may be located along the edge of planar sheet 114. Alternately, as shown in FIGS. 1B and 1D, the planar sheet may include two tabs 122 that project toward header 106. Each tap has a lip 115 along the edge of the tab.

Figure 4:
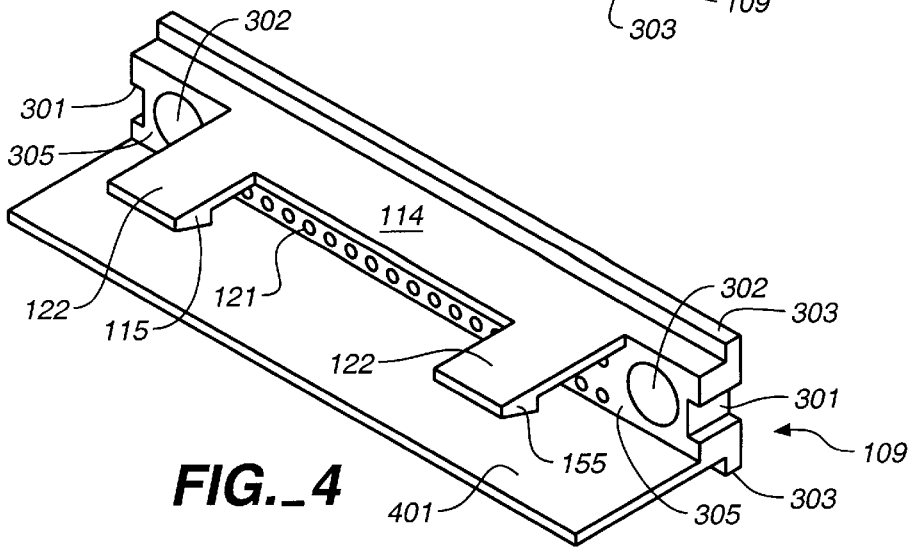
FIG. 4 is a detailed view of another embodiment of the shutter.

FIG. 4 illustrates an embodiment of the shutter that includes a shroud 401. The shroud 401 is connected to the lower edge of shutter 109 and is disposed in a generally parallel arrangement with planar sheet 114. Shroud 401 is very thin and may be formed of nylon, Mylar, standard or engineering grade thermal plastic material, thermoset material, or the like. When a Type I or II card is inserted into bay 104, springs 110 are compressed and shutter 109 and shroud 401 slide toward header 106 so that shroud 401 slips between cover 102 and electrical connection 108. The motion of shutter 109 stops when the rear face of shutter 109 contacts the front face of header 106. When the card is removed and shutter 109 is urged by compression springs 110 into its forwardmost position, shroud 401 slides out to cover and protect the side of male connector pins 107 opposite planar sheet 114.

Although Type II cards are thicker than Type I cards, either a Type I or Type II card can fit in the bay 104 formed by frame 103. In addition, since the location of the connection socket with respect to its bottom surface is the same for both Type I and Type II cards, both Type I and Type II cards will engage the offset male connector pins which extend through the offset holes in the shutter. Thus, dual mode adapter 10 is capable of connecting to either a Type I or Type II card and conforms to PCMCIA standards.

Other embodiments are within the scope of the following claims. For example, the embodiments disclosed in the figures and discussed above show an dual mode adapter and shutter mechanism conforming to the standards of the CFA. However, some aspects of the invention may apply to dual mode adapters for other small-format devices, including for example, those complying with the standards of PCMCIA, JEDIC, ISO, and others. The embodiments illustrated in the figures use springs to push the shutter forward when male connector pins are not engaged. However, other resilient materials may be used to bias the shutter away from the header. Components may be joined by sonic welding, with adhesives, by the application of heat, by chemical reaction, or by any other suitable method. Adhesives useful for joining the components include, for example, thermosetting resins and thermoplastic resins. Further, dual mode adapter components may be constructed of a variety of injection molded plastic materials including, for example, thermoplastic resins such as polycarbonate, acrylic and others, and thermosetting resins such as epoxy, silicone, and others. In each case, care is to be taken to choose compatible materials for parts to be joined and the joining system.

What is claimed is:

1. An apparatus comprising:

a female connector to connect to a peripheral card device port;

a header having a front face and male connector pins extending from the header front face to connect to a peripheral card device that is not compatible with the peripheral card device port;

an electrical connection between the female connector and the male connector pins in the header;

a frame to support the female connector, the header and the electrical connection, the frame including an upper cover a lower cover, and two opposing rails extending beyond the upper and lower covers to define a bay, the female connector disposed in an end of the frame opposite the bay, and the header disposed adjacent the bay with the male connector pins extending beyond the upper and lower covers into the bay; and a shutter having a front face, a rear face, and a plurality of holes extending from the shutter front face to the shutter rear face and corresponding to the male connector pins, the shutter holes slidably engaging the male connector pins, the shutter slidable between a first position in which the shutter substantially covers the pins and a second position in which the pins extend past the holes for electrical engagement with the peripheral card device.

2. The apparatus of claim 1, further comprising a connector pin secured to the shutter and extending through and slidably engaged with an aperture in the header.

3. The apparatus of claim 1, wherein the shutter includes a planar sheet protecting from an edge of the shutter rear face with a lip to limit forward motion of the shutter by engaging the header.

4. The apparatus of claim 1, further comprising a spring to bias the shutter away from the header.

5. The apparatus of claim 3, wherein the lip is on a tab extending from the planar sheet.

6. The apparatus of claim 1, wherein the shutter includes two rows of holes, and a centerline between the two rows of the holes in the shutter is offset from a centerline of the shutter toward a bottom face of the shutter.

7. The apparatus of claim 3, wherein the shutter includes a shroud connected opposite the planar sheet.

8. The apparatus of claim 7, wherein a flange runs along a top and a bottom of the shutter front face.

9. The apparatus of claim 1, wherein the header includes two side walls extending from the header front face, the inner surface of each side wall including a guide rail, and wherein the shutter has two sides with grooves slidably engaging the guide rails.

10. The apparatus of claim 1, wherein the female connectors conform to PCMCIA standards and the male connectors conform to CompactFlash standards.

11. A dual mode adapter comprising:

a female connector to connect to a peripheral card device port;

a male connector having a plurality of pins to connect to a peripheral card device that is not compatible with the peripheral card device port;

an electrical connection between the female connector and the male connector;

a shield to cover the pins in the male connector, the shield having a planar sheet with a lip and a plurality of holes corresponding to the pins in the male connector, the shield slidably engaged to the male connector and movable between a first position in which the pins are substantially covered and a second position in which the pins extend past through the shield for connection to the peripheral card device; and a housing to support the female connector, male connector and electrical connection, the housing having an upper cover, a lower cover, and rails extending beyond the upper and lower covers to define a bay at the end of the adapter opposite the female connector to receive the peripheral card device, the pins of the male connector extending beyond the upper and lower covers into the bay.

12. A kit comprising:

a female port to connect to a peripheral card device port;

a header having a front face, a rear face, two side walls extending from the header front face, and two parallel rows of male connector pins extending from the header front face substantially parallel to the side walls to connect to a peripheral card device, the inner surface of each side wall including a guide rail;

an electrical connector to connect the female port to the male connector pins in the header; and a shutter having a front face, a rear face, two sides with grooves configured to slidably engage the guide rails, a planar sheet projecting from an edge of the shutter rear face, and a two parallel rows of holes extending from the shutter front face to the shutter rear face and corresponding to the male connector pins, a centerline between the two rows of the holes in the shutter is offset from a centerline of the shutter toward a bottom face of the shutter.

13. The kit of claim 12, wherein the planar sheet includes a lip at an edge thereof.

14. The kit of claim 13, wherein the planar sheet includes a tab, and the lip is located at an edge of the tab.

15. The kit of claim 12, further comprising:

means for connecting the header to the shutter; and means for biasing the shutter away from the header.

16. A dual mode adapter comprising:

a female connector to be connected to a PCMCIA device port;

a male connector having a two rows of pins to connect to a FlashCard electronic device;

an electrical connection between the female connector and the male connector;

a shield for covering the pins in the male connector, the shield having a two rows of holes corresponding to the pins in the male connector and in sliding engagement therewith, a centerline between the two rows of the holes in the shield being offset from a centerline of the shield toward a bottom face of the shield; and a housing to support the female connector, male connector and electrical connection, the housing having an upper cover, a lower cover, and two opposing side rails that extend beyond the upper and lower covers to define a bay that is open along two opposing sides at the end of the adapter opposite the female connector, wherein the pins extend beyond the upper and lower covers into the bay, the configuration of the pins, shield and housing enabling connection of either a type I or a type II CompactFlash electronic device to the male connector.

* * * * *